United States Patent [19]

Easter

[11] 3,951,021

[45] Apr. 20, 1976

[54] SWITCHING APPARATUS FOR ELONGATED, HOT ROLLED ARTICLES

[75] Inventor: Holton C. Easter, Munster, Ind.

[73] Assignee: Inland Steel Company, Chicago, Ill.

[22] Filed: Oct. 29, 1974

[21] Appl. No.: 518,263

[52] U.S. Cl. ..... 83/81; 83/106; 198/31 AC; 271/64

[51] Int. Cl.[2] ..... B26D 7/06

[58] Field of Search ..... 198/185, 31 R, 31 AA, 198/31 AB, 31 AC, 38, 30; 271/64; 83/106, 81

[56] References Cited

UNITED STATES PATENTS

| | | | |
|---|---|---|---|
| 2,251,596 | 8/1941 | O'Malley | 271/64 X |
| 2,847,107 | 8/1958 | Pennington | 198/31 AC |
| 3,193,078 | 7/1965 | Amenta et al. | 198/31 AC |
| 3,831,929 | 8/1974 | Hellmer | 271/64 |

*Primary Examiner*—Albert J. Makay
*Assistant Examiner*—James M. Slattery
*Attorney, Agent, or Firm*—Merriam, Marshall, Shapiro & Klose

[57] ABSTRACT

Switching apparatus for hot rolling mill. Alternate hot rolled bars are diverted and guided alternately along respective diverging paths. The paths are defined by opposite sides of a trough and a pivoting knife switch located between the trough sides. Pivotable persuader elements upstream of the knife switch are pivoted to deflect alternate bars toward alternate paths. The knife switch pivots between alternate positions to provide a wide mouth for the path toward which the approaching bar is deflected by the persuader elements and to constrict the other path. The persuader elements block a bar from entering a path toward which that bar is not deflected. Movement of the persuader elements and knife switch, for changing the path of an approaching bar, is relatively slow. No slamming into or squeezing or scratching of bars by the persuader elements or knife switch.

10 Claims, 12 Drawing Figures

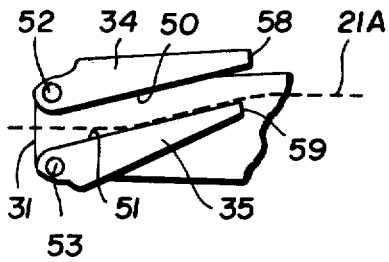
FIG.3
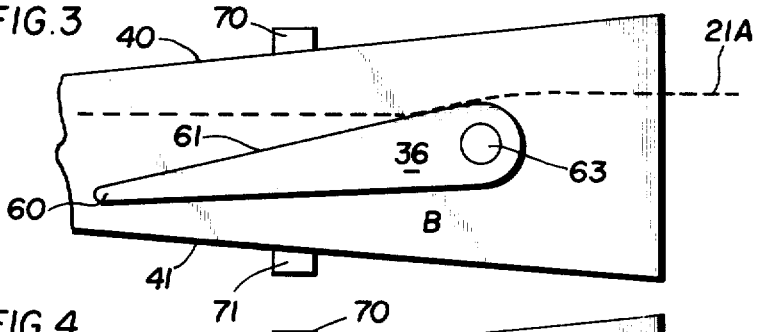
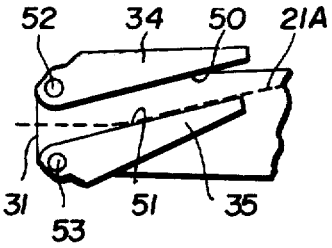
FIG.4
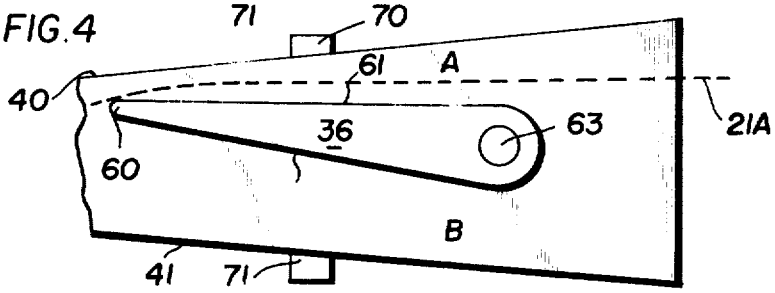
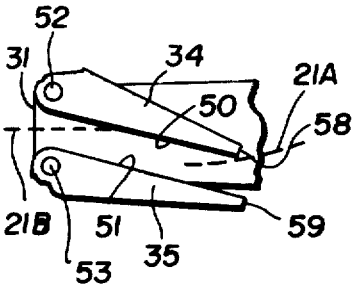
FIG.5
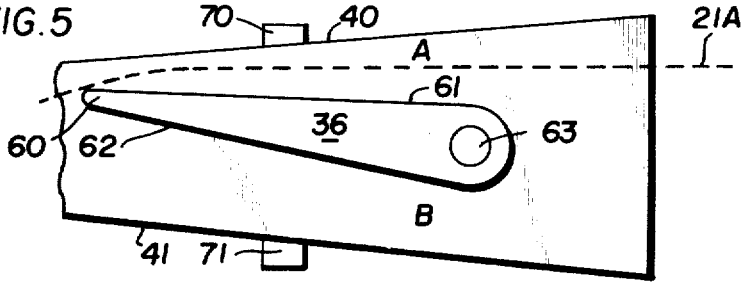
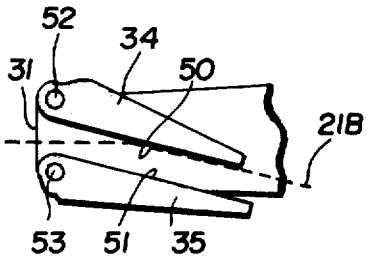
FIG.6
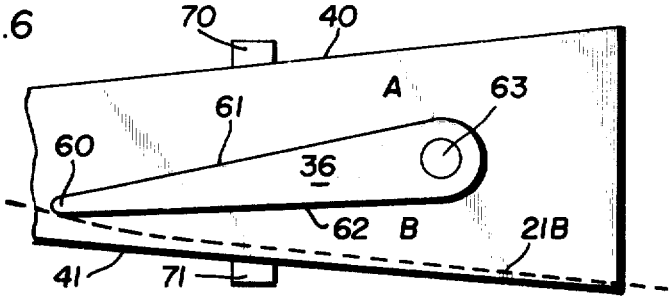
FIG.7
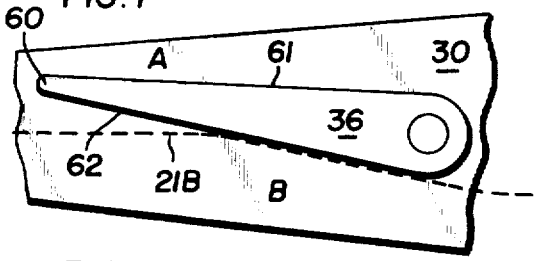
FIG.8
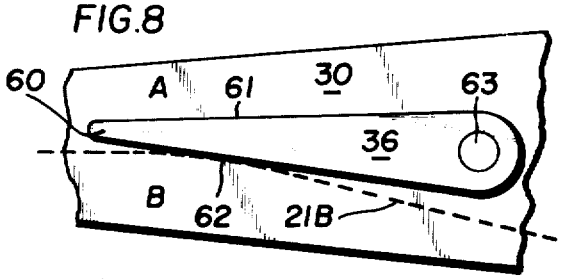
FIG.9
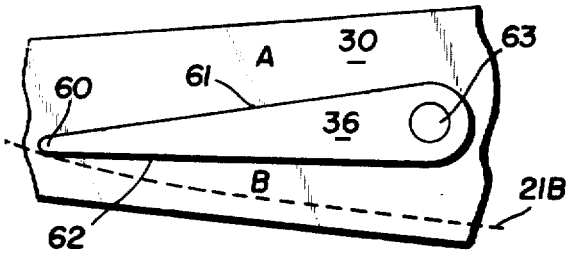
FIG.10
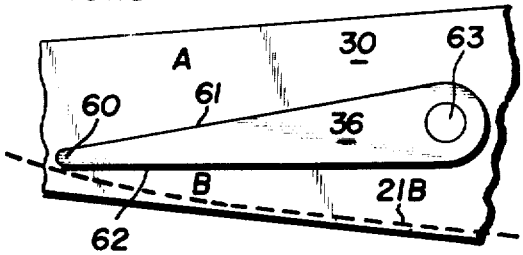

SWITCHING APPARATUS FOR ELONGATED, HOT ROLLED ARTICLES

BACKGROUND OF THE INVENTION

The present invention relates generally to rolling mill apparatus for handling elongated, hot rolled articles such as hot rolled bars. More particularly, the invention relates to apparatus, in a hot rolling mill, which switches hot rolled bars alternately back and forth between two diverging paths.

Conventional switches, previously employed in hot rolling mills, included both vertical switches, which diverted alternate bars to paths diverging above and below the switch, and horizontal switches which diverted bars alternately to paths diverging to the left and to the right of the switch. Most such switches comprised a member, elongated in the direction of movement of the bar, pivoted at one end and having edges or surfaces which engaged a bar to divert or guide the bar along one path or another. A so-called "knife switch" fits this description.

Among the drawbacks of conventional, previously employed switches were that such switches couldn't be changed to divert a second or approaching bar, which had not yet arrived at the switch, until the tail of a preceding bar already undergoing switching was completely past the switch; and it was necessary to accelerate the tail of the preceding bar so as to provide a gap between it and the head of the approaching bar. Also, there was the danger of a head-on collision between the nose of the switch and the head of the approaching bar if the switch had not completed its movement to divert the approaching bar before the head of the approaching bar reached the switch. Such a collision could cause damage to the bar or cobbling (i.e., tangling), requiring a shut down of that portion of the mill where the cobble occurred, for removal of the cobble which was then scrapped.

Because of the relatively short time available to change the switch for diverting bars from one path to another, it was often necessary to use a fast-acting switch which, because of the rapidity of its movement, produced a slamming action or a relatively large impact against the approaching bar. Because the bar was relatively hot as it passed through the switch (e.g., 1700°–1900°F) there was a danger that the slamming action of the switch could deform the bar to an extent greater than that from which the bar could recover; and an unrecoverable bend in the bar could cause cobbling, among other things.

If the switch was moved to divert the approaching bar before it reached the switch, there was a danger of exerting pressure on the tail end of the preceding bar, causing a kink which had to be cut off or straightened.

SUMMARY OF THE INVENTION

A switching apparatus constructed in accordance with the present invention avoids the above-described drawbacks of the prior art switches. The present switching apparatus comprises a trough having a knife switch located between the entry and exit ends of the trough. Located upstream of the knife switch, closer to the entry, are a pair of persuader elements. The persuader elements and the knife switch are movable between first and second positions. When they are all in their first positions they define a first path for a bar moving through the trough. When they are all in their second positions, they define a second path for a bar moving through the trough.

Respective movements of the persuader elements and the knife switch are coordinated in such a manner that bars moving through the trough are diverted, deflected and guided along the desired path without undergoing damage or the danger of cobbling. Any contact between a persuader element or knife switch, on the one hand, and the hot rolled article, on the other hand, is without intolerable pressure or impact on the article.

The knife switch and the persuader elements move relatively slowly between their positions, as distinguished from the fast-acting switches of the prior art, thereby minimizing the impact of the knife switch and persuader elements against a hot rolled bar contacted by them as they move between positions. Such operation minimizes the danger of kinking the tail end of a bar.

The downstream distance from the persuader elements to the knife switch is sufficiently long to avoid unrecoverable kinking of a bar moving through the trough no matter the respective positions of the persuader elements and the knife switch.

Movement of the knife switch between its first and second positions changes the width of a path mouth from a relatively wide mouth to a relatively constricted one. Nevertheless, the persuader elements and the knife switch are so correlated in their movements that an article entering the trough is always directed towards a path having a relatively wide mouth. Moreover, adjustment means are provided so that the width of even a constricted path is always greater than the lateral dimension of a bar moving along that path, to avoid scratching the bar.

As previously noted, the speed of movement of the persuader elements and knife switch between positions is relatively slow, so that they must start such movements while a preceding bar is still moving past the particular persuader element or knife switch. As a result, the bar is often pushed laterally, from side to side of the trough, by the persuader element or knife switch as they move between positions. However, because such movement is relatively slow, any contact with the bar merely causes a gradual urging of the bar laterally across its path of movement, without intolerable pressure or intolerable impact on the bar. There is no slapping of the article, as would occur with a fast-acting switch or persuader element. Whatever pressure or impact the bar is subjected to is within the limits from which the bar can recover at the temperature at which it proceeds through the switching apparatus.

Another advantage of using slow-acting switches is that there is less wear and tear and less lubrication is required. Imperfections in the switches resulting from normal wear and tear can be better tolerated and absorbed at relatively low operating speeds than at higher speeds.

Other features and advantages are inherent in the structure claimed and disclosed or will become apparent to those skilled in the art from the following detailed description in conjunction with the accompanying diagrammatic drawings.

BRIEF DESCRIPTION OF THE DRAWING

FIGS. 3–6 are diagrammatic plan views illustrating the sequence of movement of the persuader elements and knife switch for diverting hot rolled bars alternately between diverging paths;

FIGS. 7–10 are diagrammatic plan views illustrating the manner in which the knife switch gradually urges the hot rolled bar laterally along its predetermined path, as the knife switch moves between positions;

DETAILED DESCRIPTION OF PREFERRED EMBODIMENTS

Figure 11:
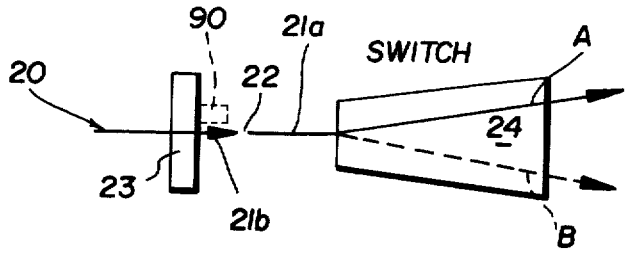
FIG. 11 is a flow diagram illustrating the passage of a hot rolled bar through the apparatus.

Referring initially to FIG. 11, a continuous strand 20 of hot rolled material moves through a conventional flying shear 23 where it is cut at 22 into articles such as bars 21*a*, 21*b* having predetermined lengths. The first or preceding bar 21*a* follows a path A through a switching apparatus 24. The next bar cut from strand 20 (i.e., bar 21*b*) will follow a path B through switching apparatus 24.

Articles 21*a*, 21*b* may have a round, rectangular or polygonal cross-section, or they may be in the form of a flat bar or a shape such as an angle iron or channel. The hot rolled articles 21*a*, 21*b* are generally in the temperature range 1700°–1900°F as they move through flying shear 22 and switching apparatus 24.

Figure 1:
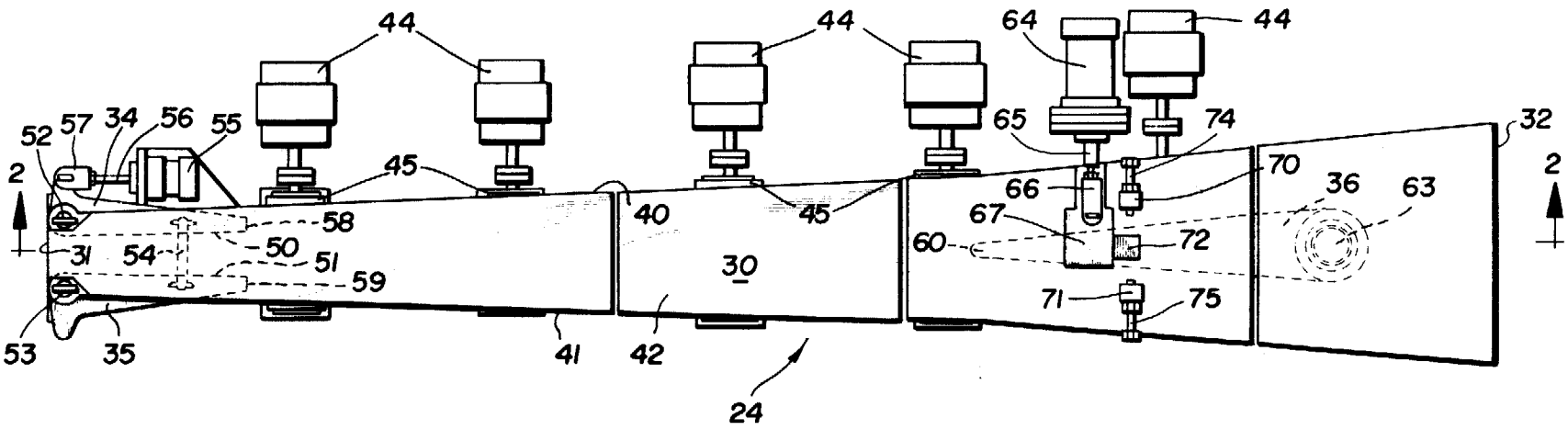
FIG. 1 is a plan view of an embodiment of switching apparatus in accordance with the present invention.
Figure 2:
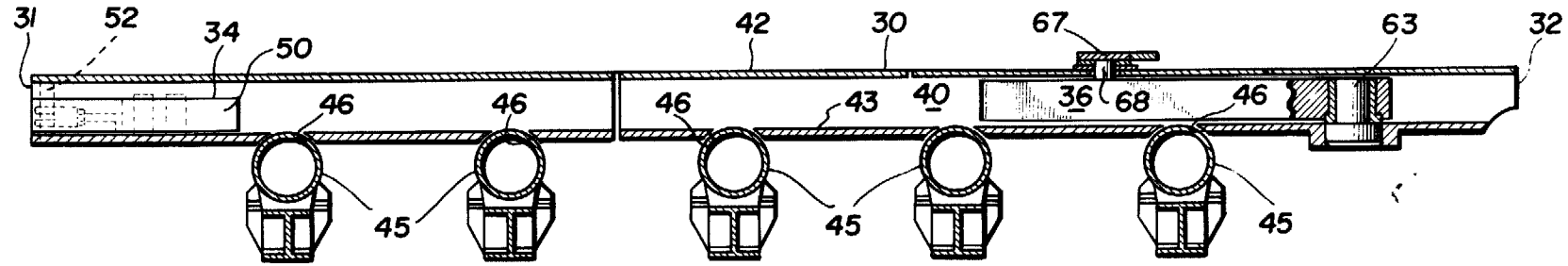
FIG. 2 is a sectional view taken along line 2—2 of FIG. 1.

Referring to FIGS. 1 and 2, switching apparatus 24 comprises a trough 30 having an entry 31, an exit 32 and a pair of opposed side walls 40, 41. Mounted on trough 30, upstream of exit 32 are persuader elements 34, 35 mounted adjacent entry 31 in the embodiment illustrated in FIGS. 1 and 2. Located between persuader elements 34, 35 and trough exit 32 is a knife switch 36. Knife switch 36 is disposed between the opposed side walls 40, 41 of trough 30 to define therewith the two elongated paths A, B extending along trough 30 between its entry and exit 31, 32.

Persuader elements 34, 35 are mounted for movement between a first position, illustrated in FIGS. 3–4, for deflecting an article passing entry 31 toward path A, and a second position, illustrated in FIGS. 5–6, for deflecting an article passing entry 31 toward path B. Knife switch 36 is also mounted for movement between two positions. In its first position, illustrated in FIG. 3, knife switch 36 and trough side wall 40 define a wide mouth for path A while knife switch 36 and opposite trough side wall 41 constrict path B. In its second position, illustrated in FIG. 4, knife switch 36 and trough side wall 41 define a wide mouth for path B while knife switch 36 and trough side wall 40 constrict path A.

Knife switch 36 comprises a nose portion 60, a first edge 61 and a second edge 62. First edge 61 comprises first guide means for guiding an article, moving through trough 30, along path A. Edge 62 comprises means for guiding an article moving through trough 30 along path B.

Persuader or deflector elements 34, 35 have opposed inner edges 50, 51 respectively. When deflector elements 34, 35 are in their first position (FIGS. 3–4) edge 51 on deflector element 35 comprises means for deflecting an article 21*a* toward path A. When deflector elements 34, 35 are in their second position (FIGS. 5–6) edge 50 on deflector element 34 comprises means for deflecting an article 21*b* toward path B.

Persuader elements 34, 35 are pivotally mounted at 52, 53 respectively for movements between their first and second positions. Knife switch 36 is pivotally mounted at 63 for movement between its first and second positions.

The sequence of operation of persuader elements 34, 35 and knife switch 36, for switching articles 21*a*, 21*b* into paths A and B respectively, is illustrated in FIGS. 3–6. Initially, persuader elements 34, 35 are set to deflect an article (e.g., 21*a*) towards its intended path (e.g., A), and knife switch 36 is set in a position defining a wide mouth for the path (e.g., A) toward which an article (e.g., 21*a*) is deflected by the persuader means. This is illustrated in FIG. 3.

Located alongside paths A, B, respectively, downstream of knife switch nose portion 60, are sensing means, such as conventional hot metal detectors 70, 71 which detect infrared light. When hot rolled article 21*a* moves along path A, downstream of knife switch nose portion 60 (FIG. 3), hot metal detector 70 senses that hot rolled article; and, when hot rolled article 21*b* moves along path B, downstream of knife switch nose portion 60 (FIG. 6), hot metal detector 71 senses that hot rolled article. When article 21*a* is sensed by detector 70, the latter actuates mechanism (to be subsequently described) for moving knife switch 36 from its first position (FIG. 3) to its second position (FIG. 4) and for moving the persuader elements 34, 35 from their first position (FIGS. 3–4) to their second position (FIGS. 5–6). Similarly, when article 21*b* is sensed by detector 71, that actuates mechanism (to be subsequently described) for moving knife switch 36 from its second position (FIG. 5) to its first position (FIG. 6) and for moving persuader elements 34, 35 from their second position (FIGS. 5–6) to their first position (FIGS. 3–4).

In FIGS. 3–6, persuader elements 34, 35 are illustrated as moving from one to the other of their respective positions after the knife switch 36 has moved from one to the other of its respective positions. However, the movement of the persuader elements from their first to their second position can be timed so as to be essentially simultaneous with the movement of the knife switch 36 from its first to its second position.

The persuader elements 34, 35 and the knife switch 36 are always in such a relation that, when an article 21 initially encounters the persuader means 34, 35, the article is deflected by the persuader elements toward the path A or B which has a wide mouth at that particular time, and the article is blocked by the persuader elements from entering the path A or B which is constricted at that particular time.

When they change positions, the persuader elements do not move all the way across trough 30, but they do move enough to give article 21 an angular deflection toward the desired path and to block the other path from entry by the article.

Knife switch 36 moves from one position to another while the tail end of an article 21 moving past the knife switch is still upstream of nose portion 60 of the knife switch. When this occurs, the knife switch pushes the article 21 laterally across the article's path of movement. However, because the knife switch moves relatively slowly, it merely gradually urges article 21 laterally across its path without intolerable pressure or impact on the article. This is illustrated in FIGS. 7–10 which show the gradual lateral urging of article 21*b* across its path of movement B as knife switch 36 moves from its second position to its first position. The time it takes for knife switch 36 to move from one position to another is typically from one-half to two-thirds the time it takes for a bar length to move past a given point on the knife switch, depending upon the length and linear speed of the bar.

For an apparatus having the dimensions described below, the length of a bar passing through the switch is in the range 80–240 feet with a preferable minimum length of 180 feet. The maximum length of the bar is determined by the length of bar which can be accommodated downstream of the switching apparatus. The speed of the bar is typically in the range 800–2400 feet per minute.

Although the knife switch moves slowly, the switching of bars from one path to another is rapid, comparable to that obtained with fast-acting prior art switches. This is because the knife switch starts changing position to accommodate an approaching bar when the head of the preceding bar is still moving past the knife switch.

Movement between positions of persuader elements 34, 35 occurs while an article 21 is moving past the persuader elements and while the tail of that article is upstream of the persuader elements. Just as with the movement of the knife switch, movement of the persuader elements pushes article 21 laterally across its path of movement. However, this movement, too, is relatively slow and thus causes merely a gradual urging of article 21 laterally across its path of movement, without pressure or intolerable impact on the article 21.

The longitudinal distance between the respective downstream ends 58, 59 (FIG. 1) of persuader elements 34, 35 and the upstream end or nose portion 60 of knife switch 36 is sufficiently great to avoid unrecoverable kinking of an article 21 having a length greater than that distance, no matter the respective positions of the persuader elements and the knife switch. Thus, assuming that the persuader elements and the knife switch were in the positions shown in FIG. 5, and assuming that the tail end of article 21*a* has not yet passed the downstream end 58 of persuader element 34, the distance between downstream end 58 and nose portion 60 is sufficiently great to avoid unrecoverable kinking of article 21*a* at the temperature at which it moves through trough 30. For example, in one embodiment of switching apparatus where the persuader elements are about two and three-quarter feet long and the knife switch is five feet long, the distance between downstream ends 58, 59 and nose portion 60 is about nine feet. In other embodiments the distance ranges between five feet and twenty feet.

Referring to FIGS. 1 and 2, trough 30 optionally includes a top 42 and a bottom 43. A plurality of motors 44 (FIG. 1) drive rollers 45 extending upwardly through openings 46 in trough bottom 43. Rollers 45 comprise means for conveying an elongated hot rolled article 21 through trough 30 from the entry to the exit thereof.

Each persuader element 34, 35 has its respective upstream end portion pivotally mounted between the top 42 and bottom 43 of trough 30 at 52, 53 respectively. Elements 34, 35 are connected for pivotal movement together by link means 54. Movement of elements 34, 35 is affected by a piston 55 having a piston rod 56 connected to a linkage 57 connected to element 34 (FIG. 1).

Knife switch 36 is mounted for pivotal movement about the axis of a pin 63, located at the downstream end of knife switch 36 and mounted between the top 42 and bottom 43 of trough 30. Movement of knife switch 36 is affected by a piston 64 having a piston rod 65 connected by a linkage 66 to a plate 67 located above knife switch 36 and connected thereto by a pin 68 extending through trough top 42.

Pivotal movement of knife switch 36 in either direction is limited by stops 70, 71 engaging an arm 72 extending downstream from plate 67. Each stop 70, 71 is threadably mounted on a threaded member 74, 75, respectively, to permit adjustment of stops 70, 71 so as to change the limits of movement of knife switch 36. Stops 70, 71 are adjusted so as to maintain the lateral dimension of a constricted path (defined on one side by knife switch 36) greater than the lateral dimension of an article 21 moving along that path. For example, referring to FIG. 3, when knife switch 36 is in its first position, restricting path B, the lateral dimension between edge 62 of knife switch 36 and trough side 41, at the closest distance between the two (at nose portion 60 of knife switch 36), is greater than the lateral dimension of an article 21*b* moving along path B. This prevents article 21*b* from being squeezed between knife switch 36 and trough side 41 which would scratch the article, and that is undesirable.

Figure 12:
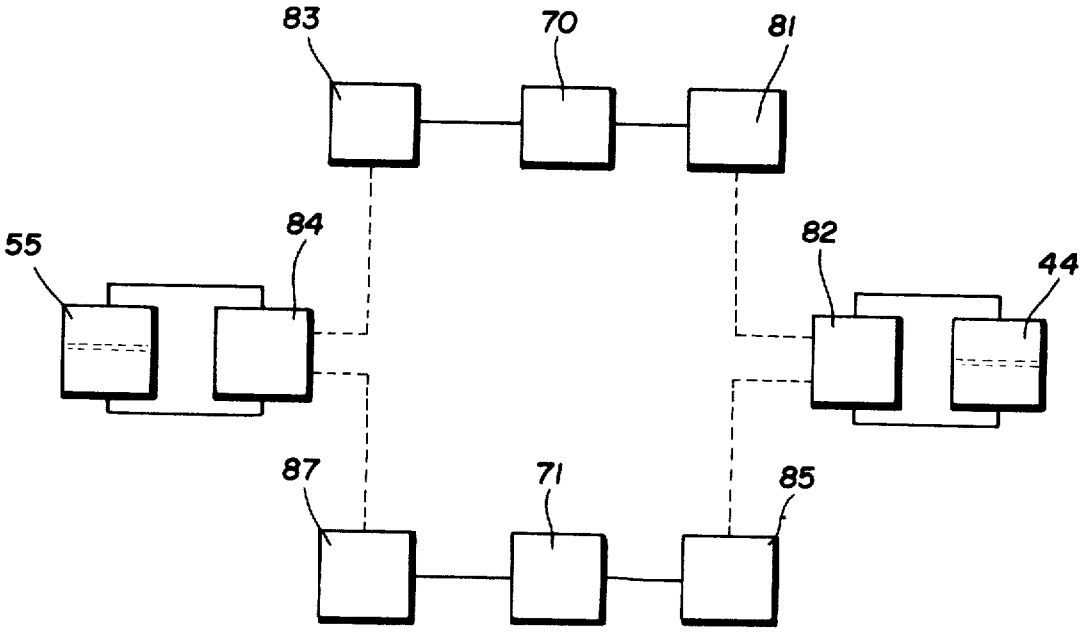
FIG. 12 is a schematic diagram illustrating portions of the electrical, mechanical and pneumatic connections in one embodiment of the apparatus.

FIG. 12 illustrates the mechanisms actuated by hot metal detectors 70, 71 to move the knife switch and the persuader elements. More specifically, when hot metal detector 70 senses hot article 21*a* (usually at 1700°–1900°F), detector 70 electrically actuates a solenoid 81 which mechanically operates an air valve 82 to introduce compressed air into one side of piston 44 to move knife switch 36 from its first to its second position. At the same time, hot metal detector 70 electrically actuates a solenoid 83 which mechanically operates an air valve 84 to introduce compressed air into one side of piston 55 to move persuader elements 34, 35 from their first to their second positions.

When knife switch 36 is in its first position (FIG. 3) and an article 21*a* moves along path A, switch 36 blocks detector 71 from sensing article 21*a* but does not prevent detector 70 from doing so. Similarly, knife switch 36 blocks detector 70 from sensing an article 21*b* moving along path B (FIG. 6) but does not prevent detector 71 from doing so.

When detector 71 senses hot article 21*b*, it electrically actuates a solenoid 85 which mechanically operates air valve 82 to introduce compressed air into the other side of piston 44 to move knife switch 36 from its second to its first position. At the same time, detector 71 electrically actuates a solenoid 87 which mechanically operates air valve 84 to introduce compressed air into the other side of piston 55 to move the persuader elements from their second to their first positions.

If desired, timers can be interposed between detectors 70, 71 and persuader solenoids 83, 87 to delay the movement of the persuader elements until slightly after movement of the knife switch. The important consideration is that the head of the next article 21 approaching knife switch 36 still be upstream of nose portion 60 when the persuader elements complete their change of position.

As an alternative to actuation by detectors 70, 71, persuader solenoids 83, 87 can be actuated by a sensor 90 located at shear 23 (FIG. 11) and energized when shear 23 makes a cut 22.

With the above-described apparatus, it matters not if the head of a succeeding bar overtakes the tail of a preceding bar while the latter is moving past the knife switch. The present apparatus can accommodate such a situation, and it is not necessary to accelerate the tail end of the preceding bar to avoid such a situation.

The foregoing detailed description has been given for clearness of understanding only, and no unnecessary limitations should be understood therefrom, as modifications will be obvious to those skilled in the art.

What is claimed is:

1. An apparatus for handling elongated, hot rolled articles, said apparatus comprising:

an elongated trough having opposed side walls, an entry and an exit;

means for conveying an elongated hot rolled article through said trough from said entry to said exit;

persuader means on said trough and located upstream of said exit;

a knife switch on said trough and located between said persuader means and said exit;

said knife switch being disposed between said opposed side walls of the trough to define therewith a pair of elongated paths extending along said trough between said entry and said exit thereof;

means mounting said persuader means for movement between first and second positions thereof;

first deflecting means on said persuader means, operable when the persuader means is in said first position thereof, for deflecting an article, passing said entry, toward a first of said two paths;

second deflecting means on said persuader means, operable when the persuader means is in said second position thereof, for deflecting an article, passing said entry, toward a second of said two paths;

means actuable to move said persuader means from one to another of its two positions in response to a predetermined occurrence;

said knife switch including a nose portion located farther upstream than any other portion of the knife switch;

means mounting said knife switch for movement between (1) a first position in which the knife switch and one trough side wall define a wide mouth for the first path and in which the knife switch and the other trough side wall constrict the second path and (2) a second position in which said knife switch and the other trough side wall define a wide mouth for the second path and in which the knife switch and said one trough side wall constrict the first path;

said knife switch comprising first and second guide for guiding an article, moving through said trough, along said first and second paths respectively;

means for initially setting said knife switch in a position defining a wide mouth for the path toward which an article is deflected by said persuader means;

and means, responsive to movement of a deflected article downstream of the nose portion of the knife switch, for moving the knife switch to a position constricting the path along which said deflected article is moving.

2. An apparatus as recited in claim 1 wherein each of said constricted paths and said articles moving along said paths each have a respective lateral dimension, said apparatus comprising:

adjustable means for maintaining said lateral dimension of a constricted path greater than the lateral dimension of an article moving along said path.

3. An apparatus as recited in claim 1 wherein the distance between said persuader means and the nose of said knife switch is sufficient to avoid unrecoverable kinking of an article having a length greater than said distance, no matter the respective positions of the persuader means and the knife switch.

4. An apparatus as recited in claim 1 and comprising:

means, including means on said persuader means, for blocking an article from entering any one of said two paths while the path is constricted by said knife switch.

5. An apparatus as recited in claim 4 wherein said blocking means comprises means for moving said persuader means to a position for blocking the constricted path before an article, moving toward the knife switch from a location thereof, reaches the nose of the knife switch.

6. An apparatus as recited in claim 5 and comprising:

means, including means on the persuader means, for gradually urging an article laterally in said trough, without pressure and without intolerable impact on said article, as the persuader means moves between its two positions.

7. An apparatus as recited in claim 5 wherein said moving means comprises means for moving the persuader means to said position for blocking the constricted path before the head of said article passes said persuader means.

8. An apparatus as recited in claim 1 and comprising:

means, including means on said knife switch, for gradually urging an article laterally across its path of movement, without pressure and without intolerable impact on said article, as the knife switch moves between its two positions.

9. An apparatus as recited in claim 1 and comprising:

means, including means on said persuader means, for gradually urging an article laterally across its path of movement, without pressure and without intolerable impact on said article, as the persuader means moves between its two positions.

10. An apparatus as recited in claim 1 and comprising:

a shear, located upstream of said bed, for shearing said article;

said means actuable to move the persuader means comprising means responsive to a shearing action of said shear on said article.

* * * * *

UNITED STATES PATENT AND TRADEMARK OFFICE

CERTIFICATE OF CORRECTION

PATENT NO. : 3,951,021
DATED : April 20, 1976
INVENTOR(S) : Holton C. Easter

It is certified that error appears in the above-identified patent and that said Letters Patent are hereby corrected as shown below:

Column 7, line 54, after "guide" insert --means--.

Signed and Sealed this

Seventh Day of September 1976

[SEAL]

*Attest:*

RUTH C. MASON
*Attesting Officer*

C. MARSHALL DANN
*Commissioner of Patents and Trademarks*